United States Patent [19]

Breillatt, Jr. et al.

[11] 3,955,755

[45] May 11, 1976

[54] CLOSED CONTINUOUS-FLOW CENTRIFUGE ROTOR

[75] Inventors: Julian P. Breillatt, Jr., Oak Ridge; Carl J. Remenyik, Knoxville; Walter K. Sartory, Oak Ridge; Louis H. Thacker, Knoxville, all of Tenn.; William Z. Penland, Bethesda, Md.

[73] Assignee: The United States of America as represented by the United States Energy Research and Development Administration, Washington, D.C.

[22] Filed: Apr. 25, 1975

[21] Appl. No.: 571,667

[52] U.S. Cl. ..... 233/3; 233/27; 233/19 R

[51] Int. Cl.[2] ..... B04B 11/04

[58] Field of Search ..... 233/19 R, 1 A, 3, 11, 233/21, 27, 28, 31, 32, 33, 16, DIG. 1; 55/203

[56] References Cited

UNITED STATES PATENTS

| | | | |
|---|---|---|---|
| 3,655,123 | 4/1972 | Judson | 233/21 |
| 3,730,422 | 5/1973 | Cho | 233/16 |
| 3,856,483 | 12/1974 | Rumpf | 55/203 X |
| 3,862,715 | 1/1975 | Remenyik | 233/31 X |

*Primary Examiner*—George H. Krizmanich
*Attorney, Agent, or Firm*—Dean E. Carlson; David S. Zachry; Allen H. Uzzell

[57] ABSTRACT

A blood separation centrifuge rotor having a generally parabolic core disposed concentrically and spaced apart within a housing having a similarly shaped cavity. Blood is introduced through a central inlet and into a central passageway enlarged downwardly to decrease the velocity of the entrant blood. Septa are disposed inside the central passageway to induce rotation of the entrant blood. A separation chamber is defined between the core and the housing wherein the whole blood is separated into red cell, white cell, and plasma zones. The zones are separated by annular splitter blades disposed within the separation chamber. The separated components are continuously removed through conduits communicating through a face seal to the outside of the rotor.

5 Claims, 3 Drawing Figures

CLOSED CONTINUOUS-FLOW CENTRIFUGE ROTOR

BACKGROUND OF THE INVENTION

This invention was made in the course of, or under, a contract with the Energy Research and Development Administration. The present invention is generally a continuous flow centrifuge rotor, and more specifically a closed-type continuous flow centrifuge rotor.

Human leucocytes (white blood cells) are found in several varieties. Granulocytes are leucocytes which are phagocytic and protect the body against infection. In some forms of leukemia, while the patient has a superabundancy of granulocytes, for the most part they are immature and incapable of carrying out their phagocytic function. Accordingly, death in human leukemia is most frequently attributable to infections in patients with a deficiency of mature granulocytes. Ganulocyte replacement therapy can reverse the usual course of infection in such patients.

In order to carry out granulocyte replacement it is necessary to remove transfusible quantities of white blood cells from a donor's blood and introduce the white cells into the patient. While this can be done with a sequential batch-type separation technique, it is impractical because a human donor can have only about one liter of blood removed at a time without risking harm to himself. However, the normal human body is capable of producing granulocytes whenever they are needed and indeed this is what happens when a normal human acquires an infection.

This fact makes a continuous granulocyte separation process most attractive. Blood is removed continuously from a healthy donor, centrifuged to remove the white cells, and the remainder of the blood is continuously returned to the donor. The centrifuge is designed to require a volume of no more than about one liter of blood, hence the donor is never deprived of more than about one liter of blood at any time. The separated white cells are introduced into the patient. The performance of centrifuges used for this separation varies widely from donor to donor, and the yield of white cells obtained has not been entirely satisfactory. Therefore, granulocyte replacement therapy has not been widely adopted.

The centrifugal separation of blood components is based upon an application of Stoke's law. Stoke's law states in part that the sedimentation of particles in a suspending medium is directly proportional to the size and density of the particles. In whole blood, the red cells tend to form rouleaux (agglomerates) which are larger than the white cells. Therefore, red cell rouleaux will sediment faster than white cells. When whole blood is placed in a centrifuge, the centrifugal field causes the components to separate into three zones, an outer zone of red cell rouleaux, an intermediate zone of white cells, and an inner zone of plasma.

One of the most important problems encountered in blood centrifuges is that the shear stress in the separation chamber is so large that red cell rouleaux are broken up, and hence no longer easily separable from the white cells. This shear stress may be conveniently expressed as a fluid velocity gradient within the channels of the rotor. It is measured in units of velocity per unit distance, and has the dimensions of $sec^{-1}$. In addition, Coriolis forces acting on the particles as they sediment away from the axis of rotation may cause convective mixing between the phases. In normal blood, velocity gradients of about 5 $sec^{-1}$ or less are generally required to maintain appreciable red cell rouleaux structure.

DESCRIPTION OF THE PRIOR ART

Considerable work has been performed in the development of separation devices capable of separating transfusible quantities of granulocytes from human donors. This effort has resulted in a closed, continuous-flow, axial-flow centrifuge designed to separate whole blood into red cell, white cell, and plasma phases. This centrifuge is described by Judson et al. in 217 *Nature* 816 (1968), and in U.S. Pat. Nos. 3,489,145 (Jan. 13, 1970) and 3,655,123 (Apr. 11, 1972).

The prior art centrifuge of Judson et al shown in FIG. 1 comprises a rotor, rotary driving means, and liquid pumping means. The rotor comprises a generally cylindrical housing 1' having a generally cylindrical cavity therein, a rotor core 4', a transparent top closure 2', and a face seal lower half 6'. The assembled rotor comprises the rotor core fixedly attached to the bottom of the top closure, and the top closure fixedly attached at the periphery to the housing. The rotor core is spaced concentrically from the inside of the housing forming an annular cavity therebetween. The vertically extending portion of the annular cavity is a separation chamber. The core contains an axially extending central whole blood passageway 5' which communicates with the annular cavity and with a central whole blood inlet 9' in the face seal lower half 6'. The face seal lower half is fixedly secured to the top of the top closure, and contains four ports communicating with four conduits within the top closure. One of the ports is located concentrically with the axis of rotation of the face seal lower half and is a red cell exit port 23'. The three remaining ports are located at three distinct radii from the axis and are, respectively from the axis, a whole blood inlet port 9', a white cell exit port 24', and a plasma exit port 25'. The face seal upper half (not shown) has four ports in similar locations with respect to the axis, so that the ports in the face seal upper half (stationary) communicate with the ports in the face seal lower half (rotating) as the rotor rotates. This face seal is more precisely described in U.S. Pat. No. 3,519,201, issued May 7, 1968.

The separation chamber is widened near the top closure both centripetally and centrifugally by the reduction of the diameter of the core and the increase of the diameter of the cylindrical cavity. The three exit ports in the face seal lower half communicate with three conduits within the top closure which in turn communicate with the widened portion of the separation chamber at three radial positions. The centrifugal conduit 13' carries the red cell zone, the intermediate conduit 17' carries the white cell zone, and the centripetal conduit 16' carries the plasma zone.

Whole blood is pumped through the inlet port of the face seal into the central whole blood passageway 5' and passes downwardly into the annular cavity, horizontally into the separation chamber, then upwardly through the widened portion of the separation chamber. In the separation chamber, the whole blood is separated into a red cell rouleaux zone in the centrifugal region, and a plasma zone in the centripetal region. The region of the interface between the two zones contains the white cells. When the separated phases reach the widened portion of the separation chamber they are removed through the conduits by variable pumps located outside the rotor. An operator must observe the position of the interface through the clear top closure and regulate the pumps and the rotor speed to position the interface below the intermediate conduit.

The inefficiencies of the Judson centrifuge are due to a combination of factors which relate to disaggregation of red blood cell rouleaux and remixing of separated white cells into the red cell rouleaux. Blood is exposed to a wall velocity gradient of approximately 240 $sec^{-1}$ in the central passageway 5' and to a much higher velocity gradient flowing through the face seal. The shear rate in at least part of the horizontal portion of the annular cavity is also higher than the shear rate in the central passageway due to the presence of swirling caused by the Coriolis effect. Once in the separation chamber, stagnation of the red cell rouleaux occurs which tends to occlude the separation chamber with a concomitant increase in velocity gradient. In addition, the red cell layer forms a hydraulic jump on the centrifugal wall of the widened portion of the separation chamber causing mixing of the phases. Another inefficiency is inherent in the fact that the white cells are not adequately separated into a distinct phase and must be collected from the interface region of the red cell phase and the plasma phase, resulting in a continuous loss of red cells and plasma from the donor's blood.

SUMMARY OF THE INVENTION

It is one object of the present invention to provide a continuous-flow, axial-flow type centrifuge wherein, with respect to prior art devices, disaggregation of red blood cell roleaux as a result of shear conditions is reduced.

It is another object to provide a rotor design for increased reaggregation of red cells prior to their entrance into the separation chamber.

It is another object to provide an improved configuration of the separation chamber to optimize separation of blood components.

It is another object to provide a means for preventing convective mixing between the red cell zone and the white cell zone.

It is another object to provide means for preventing convective mixing in the collection chamber between the white cell zone and the plasma zone.

It is another object to provide means for sensing the red cell zone/white cell zone interface.

These and other objects are accomplished by providing in a continuous flow centrifuge rotor for separating whole blood into red blood cell, white blood cell, and plasma components, comprising a rotatable housing defining a generally parabolic cavity, a generally parabolic core defining an axially extending central whole blood inlet passageway, said core disposed substantially concentrically within said parabolic cavity, the periphery of said core and the interior surface of said housing being spaced apart to define an whole blood separation chamber therebetween in liquid communication with said whole blood inlet passageway whereby whole blood is centrifugally separated into concentric zones of red cells, white cells, and plasma within the vertically extending portion of the annular cavity, the improvement comprising a first annular fluid splitter blade having centrifugal and centripetal surfaces terminating at a common radius to define a sharp annular fluid splitting edge disposed between said core and said housing concentric to said core for separating red and white blood cell zones at their interface, a second annular fluid splitter blade having centrifugal and centripetal surfaces terminating at a common radius to define a sharp annular fluid splitting edge disposed between said core and said housing concentric to said core and centripetal to said first splitter blade for separating the white blood cell zone and plasma zone at their interface.

It has been found, according to this invention, that by gradually enlarging the diameter of the whole blood inlet passageway to reduce the velocity of the entrant blood, red cells are given sufficient time to form rouleaux before the blood reaches the separation chamber. It has also been found that by narrowing the width of the whole blood separation chamber between the core and the housing, with increasing radial distance from the axis of rotation, the velocity gradient at the walls of the anular cavity can be maintained below 5 $sec^{-1}$, thus preserving the red cell rouleaux structure. It has also been found that the presence of septa rotating with the core in the upper portion of the central whole blood inlet passageway to induce rotation of entrant blood substantially synchronously with the rotor reduces the shear stress because of the fact that the septa accelerate the liquid rotation by pressure gradients rather than by friction.

It has also been found that the presence of co-rotating septa in the lower portion of the central whole blood inlet passageway and within the horizontal portion of the whole blood separation chamber, to further induce rotation of the blood, reduces the shear stress. It has also been found that the first annular splitter blade being displaced downwardly from the second annular splitter blade facilitates removal of the red cell zone before packing of the white cells on the red cell zone, as well as providing for further separation of the white cell zone above the first annular splitter blade.

It has also been found that by machining the vertical periphery of the core and the vertical surface of the cylindrical cavity such that the separation chamber is tilted outwardly from the axis by an angle , the stagnation of red cell rouleaux could be reduced.

It has also been found by disposing a fiber optic loop probe so that a gap in the probe occurs within the separation chamber at the radial level of the first annular fluid splitter blade, and communicating the probe with a light source and photodetecting means outside the rotor, the degree of light extinction will be proportional to the red cell concentration between the gap in the loop probe. Electronic circuitry detects the light pulse and produces a d.c. signal proportional to its amplitude. This signal controls a variable speed plasma extraction pump in a plasma extraction line communicating with the plasma outlet. By varying the rate of plasma extraction from the rotor, the interface between the white cell zone and the red cell zone is positioned at a radial position near the first annular splitter blade.

DETAILED DESCRIPTION

Figure 1:
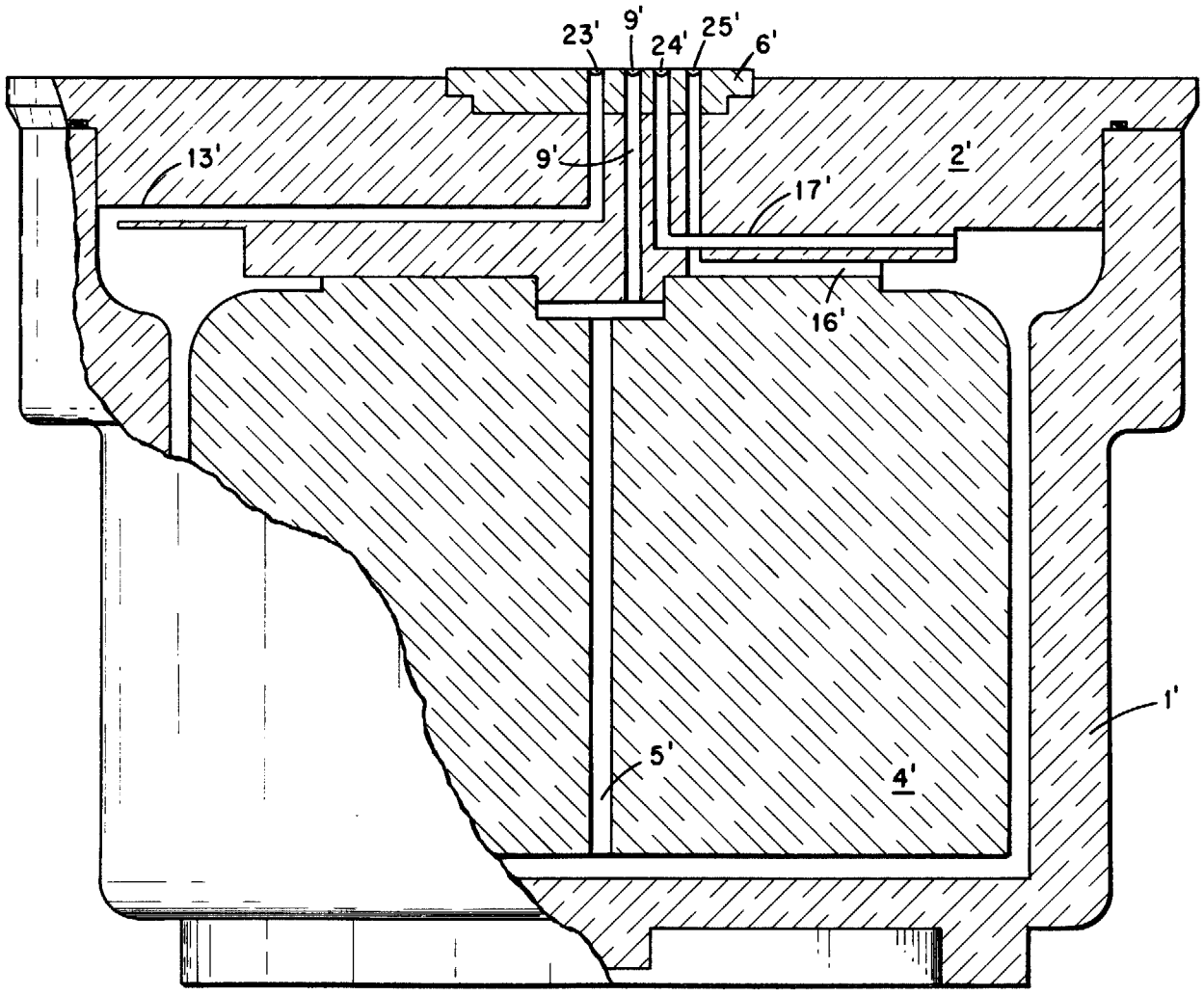
PRIOR ART Fig. 1
FIG. 1 is a vertical cross sectional view of a rotor according to Judson et al.
Figure 2:
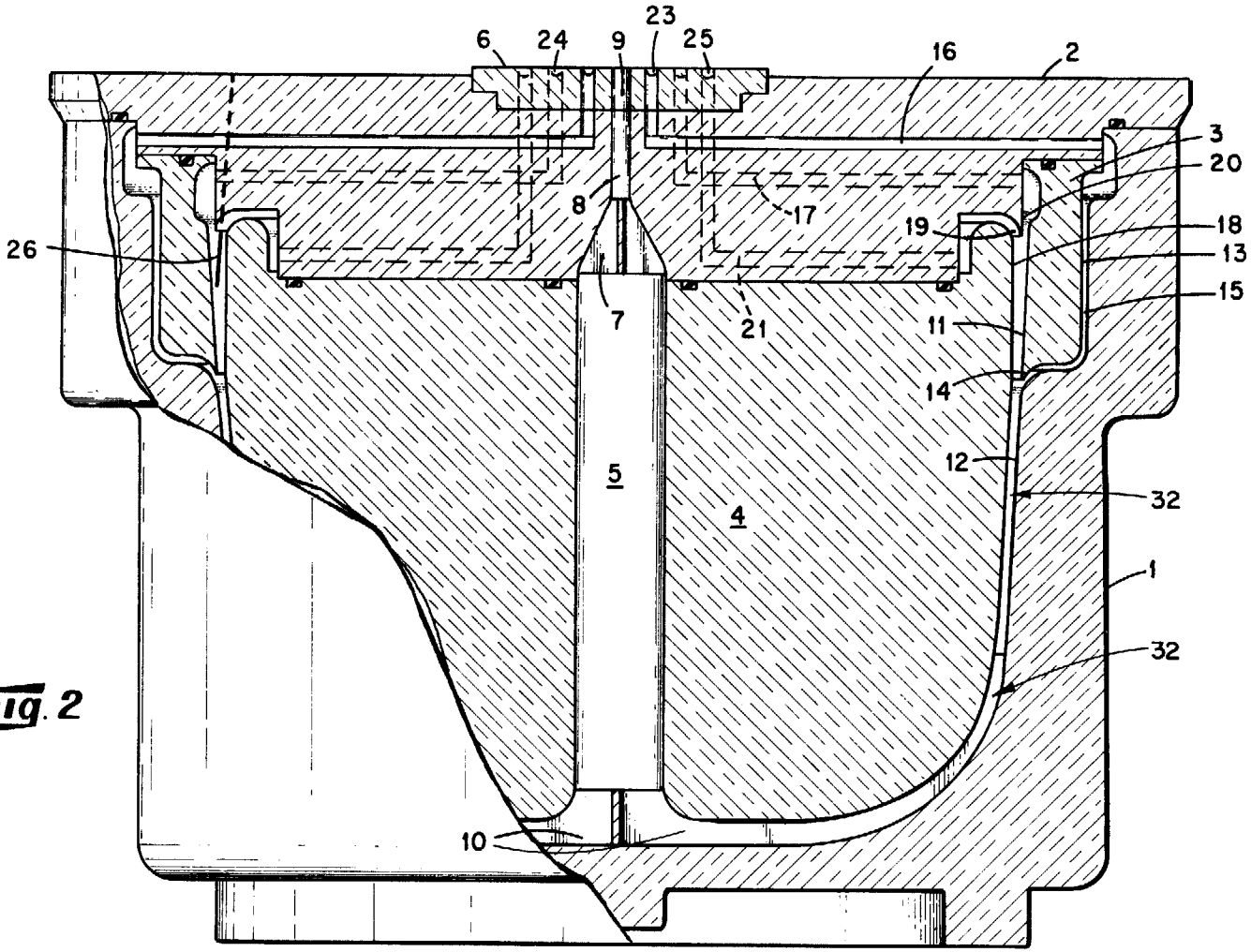
FIG. 2 is a vertical cross sectional view of the rotor according this invention.

According to the present invention, an improved rotor having the approximate overall dimensions of the Judson et al. rotor was machined from Lexan polycarbonate resin (General Electric Co.) and is shown in FIG. 2. The construction involved a rotatable bowl 1; a top closure 2 removably screwed to the bowl; a divider ring 3 removably screwed to the lower side of the top closure; a substantially solid rotor core 4 having an axially extending central whole blood passageway 5, said core being removably screwed to the top closure; a face seal lower half 6 of the type used in the Judson et al. rotor fixedly secured to the upper side of the top closure; a central whole blood inlet 8 having a gradually enlarged diameter in the top closure, interconnecting the central whole blood passageway to the face seal central whole blood port 9; a plurality of septa 7, fixedly attached to the top closure and disposed within the lower portion of the whole blood inlet; a plurality of lower septa 10, disposed at the lower end of the central whole blood inlet passageway, attached to the core, and extending radially within a full sectional space between the bottom of the core and the bowl. The bowl inside surface and core outside surface are machined to form a whole blood separation chamber 32 therebetween having a substantially axially extending portion and a substantially radially extending portion. The substantially axially extending portion of the separation chamber is flared to a 4° angle with respect to its axis. At a height of about 2.8 inches from the bottom of the 0.080 inch radial cross section separation chamber, the inner wall of the housing is offset outwardly about one half inch, then continued upward, the convex curvature and concave curvature having a radius of about 0.1 inch. The divider ring 3, 2 inches high and one half inch thick, is placed so that the inner wall 11 projects centripetally about 0.040 inch with respect to the bowl inner wall 12 at that height. The lower inside edge of the ring is elongated downwardly forming an annular fluid splitter blade 14. A red cell rouleaux outlet 15 is defined by the lower and outer surface of the ring and the outwardly extending centripetal wall of the housing.

The outerwall 13 of the divider ring 3 extends peripherally into the bowl offset wall defining an annular cavity therebetween and providing a passageway for red cell rouleaux to flow upward to a plurality of radially-oriented packed-red cell passageways 16 in the top closure communicating through the face seal with a packed red cell outlet 23.

The inner wall 11 of the divider ring forms a continuation of the separation chamber, extending upwardly at an angle of 4° and joining a plurality of radially-oriented white-cell concentrate passageways 17 in the top closure communicating through the face seal with a white-cell concentrate outlet 24.

The peripheral wall 18 of the rotor core extends vertically upward 0.79 inch above the first annular fluid splitter blade 14 to the top of the core 4 at which the core and the top closure are shaped to form an annular plasma header 19 therebetween. At this vertical level, the top closure is shaped to form a second annular phase splitter blade 20 extending centrifugally to within 0.020 inch of the divider ring inner wall 11 and downwardly into the separation chamber. The annular plasma header is joined by a plurality of radially-oriented plasma passageways 21 communicating through the face seal with a plasma outlet 25.

Figure 3:
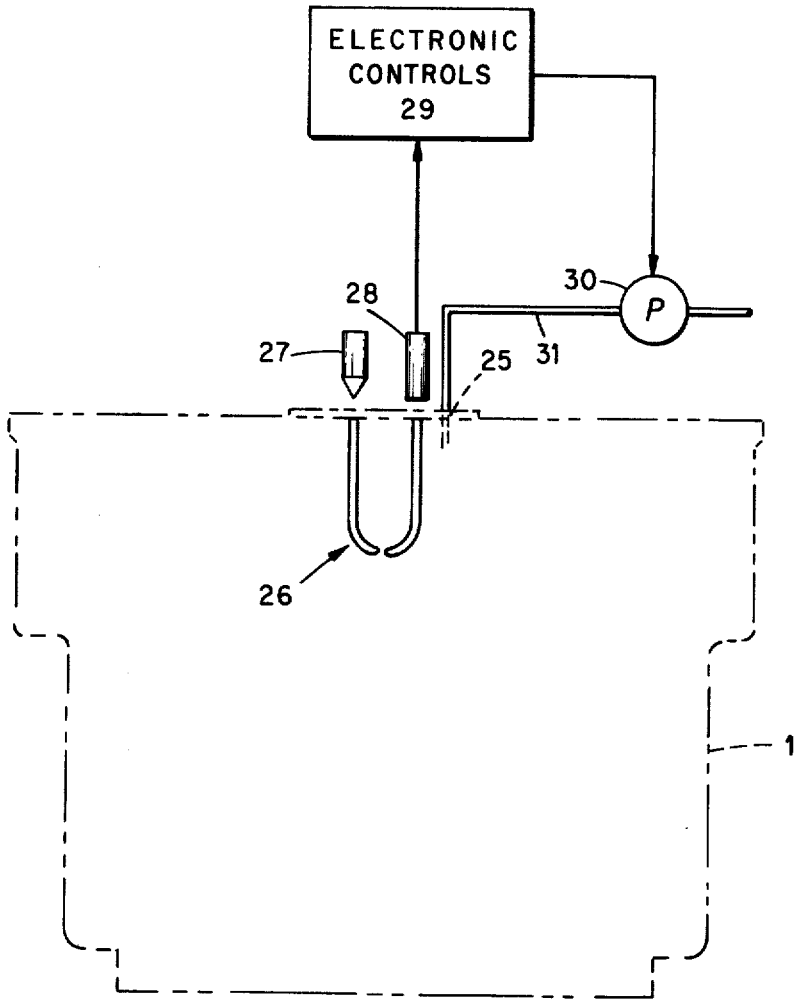
FIG. 3 is a schematic diagram of the optical interface control system.

During operation it is important that the location of the interface between the white cell phase and red cell phase be known in order that these phases be separately extracted from the rotor. In the subject invention the position of the interface is sensed optically. A fiber optic loop probe 26 consisting of two fiber optic rods is molded into the top closure so that a gap in the probe occurs within the separation chamber near the radiaal level of the first annular fluid splitter blade 14. As shown in FIG. 3, the probe communicates with a light source 27 and a photodiode or other photodetecting means 28 outside the rotor. One fiber optic rod carries white light from the light source down through the top closure of the rotor. The light is picked up by the other rod positioned a few millimeters away and carried up through the top closure and there detected by a photodiode. The light source and detector are fixed at the approximate distance from the axis of rotation of the rotor so that a pulse of light from the light source passes through the probe once during each revolution of the rotor. With a gap width of a few millimeters, absorption of light by the red cell zone is almost complete, but absorption by the white cell zone is negligible. Therefore, the total amount of light transmitted through the system depends upon what fraction of the ends of the rods are immersed in the red cell zone, that is, upon the position of the interface.

Electronic control circuitry 29 detects the light pulse and produces a D.C. signal proportional to its amplitude.

Each time the rotor rotates the probe into position in line with the light source and detector, a light pulse (whose amplitude is dependent upon the position of the interface) falls onto the photodiode. The current induced in the photodiode is amplified and fed through a diode onto a capacitor which forms the main element of a peak detector circuit. The capacitor therefore charges to a voltage which depends on the amplitude of the original light pulse. This D.C. voltage is amplified by a high input impedance F.E.T. amplifier and can then be displayed on a 0–10 volt meter as a measure of the interface position. It may also be compared with a D.C. level which is set by the operator to represent the desired interface position. The difference between the actual and desired voltages (interface positions) is used as a control signal which changes the speed of a variable speed peristalic plasma extraction pump 30 disposed in a plasma extraction line 31, communicating with the plasma outlet 25. The plasma extraction pump speed is varied in a direction which tends to pull the interface towards the desired position. Both the set point voltage and the control voltage may be displayed on the 0–10 volt meter.

A one-shot multivibrator is triggered by the leading edge of the incoming light pulse, and switches on, for a period of 50 microseconds, a transistor which drains some charge from the capacitor. The capacitor is then free to recharge to the peak value of the pulse. If it were not for this system, then the voltage on the capacitor would be able to rise if successive light pulses were larger (interface moving towards the rotor periphery), but would not be able to fall if successive peaks were smaller, because the diode would then be in a non-conducting state even at the peak of the pulse.

The design variables for a given rotor are calculated by applying fluid dynamics equations to the properties of blood. In order to reduce the velocity gradient within the whole blood separation chamber, the width of the annular cavity must decrease with increasing distance from the axis of rotation. More specifically, the relationship is given by the following expression:

$$W = \sqrt{\frac{3Q}{\pi R \left(\frac{dx}{dn}\right)_{n=0}}} \qquad \text{Eq. 1}$$

This relationship was derived by assuming laminar flow between parallel plates. The velocity x of the fluid is assumed to be distributed parabolically between the plates. The velocity gradient is (dx/dn) where $n$ is the normal distance from the wall. The velocity gradient at the wall is represented by the term $$\left(\frac{dx}{dn}\right)_{n=0}$$

Q is the rate of volume flow and R is the radial distance from the axis of rotation. Because it is desired that the velocity gradient be no more than about 5 $sec^{-1}$, that value is inserted into equation 1, as well as an appropriate value for Q to yield the proper width for the annular cavity at each radius.

If fluid dynamics equations similar to those describing Poiseuille flow are simplified and solved, with boundary conditions appropriate for a two-phase flow between parallel surfaces, and the results evaluated with the parameter values of the subject invention, including the radial location of the first annular fluid splitter blade and the 4° angle of the separation chamber, the optimum rotor speed is calculated to be 455 rpm. This result has been verified experimentally. It is, therefore, indicated that the design calculations for a given rotor may be made by combining the above relationship with an approximate solution expressing conservation of particle volume and conservation of suspension volume, satisfying the boundary conditions imposed on the sedimentation process occurring inside the centrifuge rotor under the effects of inertia and gravity. The numerical results of this theory for a specific range of desired operating conditions, spatial and material limitations of the rotor structure, and for a range of fluid mechanical properties of sedimenting blood components were applied as parameter values to the solution for two phase flow. The final numerical results give two critical design values, the separation chamber slope and the position of the first annular fluid splitter blade. The determination of all the dimensions needed to fix the rotor configuration consistent with inevitable spatial, dynamical and construction material limitations, requires iterative calculation process.

The same mathematical relationships and essentially the same calculation processes are used to determine operating conditions of a given rotor for the specific properties of a given blood. The difference in the two procedures is that, in the first, unknown design characteristics are calculated with a range of blood properties and a range of desired operating conditions as input parameters, while, in the second procedure, operating conditions are calculated with the dimensions of a given rotor and with the single set of properties of a given blood as input parameters.

The starting equations for the inventors' theory are the equation expressing conservation of volume of particles, $$\frac{\delta(ruc + ru^s c)}{\delta z} + \frac{\delta(rvc + rv^s c)}{\delta y} = 0 \qquad \text{Eq. 2}$$

and the equation expressing conservation of the volume of the suspension, $$\frac{\delta ru}{\delta z} + \frac{\delta rv}{\delta r} = 0 \qquad \text{Eq. 3}$$

In the above equations, $z$, $r$ are axial and radial coordinates and $u$, $v$ are axial and radial components of the volume-means suspension velocity, c is the concentration of particles giving the volume of particles per unit volume of suspension. Finally, $u^s$ and $v^s$ are the axial and radial components of the sedimentation velocity of the particles relative to the volume-mean suspension velocity.

The equations 2 and 3 are combined with an expression for the driving force of gravity and the centrifugal effect. The solution of the equations of motion for the two phase flow yields the following expression.

$$u = \left\{ \begin{array}{ll} \left[\frac{1}{\mu_e}\beta - \frac{\rho_e}{\mu_e}\gamma\right]\left[\frac{y}{2} - \frac{h}{3}\right]y + \frac{H_f}{h^2 H_e}\frac{Q_f}{\pi r}y & \text{for } y \leq h \\ \left[\frac{\beta}{\mu_p} - \frac{\rho_p}{\mu_p}\gamma\right]\left[\frac{(Y-y)}{2} - \frac{(Y-h)}{3}\right](Y-y) + \left[1 - \frac{H_f}{H_e}\right]\frac{Q_f}{\pi r}\frac{(Y-y)}{(Y-h)^2} & \text{for } y \geq h \end{array} \right\} \qquad \text{Eq. 4}$$

where $$\gamma = \frac{\left[\frac{(Y-h)^2}{\mu_p} - \frac{h^2}{\mu_e}\right]\left[\frac{\mu_p}{(Y-h)^2}\left(1 - \frac{H_f}{H_e}\right) + \frac{\mu_e}{h^2}\frac{H_f}{H_e}\right] - 4Y\left[\frac{1}{(Y-h)}\left(1 - \frac{H_f}{H_e}\right) - \frac{H_f}{hHe}\right]}{\left[\frac{(Y-h)^2}{\mu_p} - \frac{h^2}{\mu_e}\right]\left[\rho_p(Y-h) + \rho_e h - Y\right]\left[\frac{\rho_p}{\mu_p}(Y-h)^2 - \frac{\rho_e}{\mu_e}h^2\right]} \frac{3Q_f}{2\pi r}$$

and where $$\beta = \frac{\left[\frac{\rho_p}{\mu_p}(Y-h)^2 - \frac{\rho_e}{\mu_e}h^2\right]\left[\frac{\mu_p}{(Y-h)^2}\left(1 - \frac{H_f}{H_e}\right) + \frac{\mu_e}{h^2}\frac{H_f}{H_e}\right] - 4\left[\frac{1}{(Y-h)}\left(1 - \frac{H_f}{H_e}\right) - \frac{H_f}{hH_e}\right]\left[\rho_p(Y-h) + \rho_e h\right]}{\left[\frac{(Y-h)^2}{\mu_p} - \frac{h^2}{\mu_e}\right]\left[\rho_p(Y-h) + \rho_e h\right] - Y\left[\frac{\rho_p}{\mu_p}(Y-h)^2 - \frac{\rho_e}{\mu_e}h^2\right]} \frac{3Q_f}{2\pi r}$$

$\mu_e$ is the average viscosity of the red cell zone (poise)
$\rho_e$ is the average density of the red cell zone ($g/cm^3$)
$y$ is the normal distance from the interior surface of the housing (cm)

$h$ is the thickness of the red cell zone (cm)

$H_f$ is the feed hematocrit, the ratio of particle volume to blood volume $H_e$ is the exit hematocrit $Q_f$ is the volumetric feed rate ($cm^3$/sec)

$r$ is the normal distance to the centrifuge axis of rotation (cm)

$\mu_p$ is the viscosity of the plasma zone (poise)

$\rho_p$ is the density of the plasma zone ($g/cm^3$)

Y is the gap width of the separation chamber (cm)

To use Eq. (4) we first prescribe values of the parameters $\mu_e$, $\rho_e$, $H_f$, $H_e$, $Q_f$, $r$, $\mu_p$, $\rho_p$ and Y. We then seek (by trial-and-error or other means) to find a value of h such that $u$ 0 over the entire range 0 $y$ Y.

Such a value of h, when found, is considered to specify a stable operating condition. The corresponding angle of the separation chamber, measured relative to the axis, is then given by $$\alpha = \arcsin \frac{\gamma}{\sqrt{(\omega^2 r)^2 + g^2}} + \arctan \frac{g}{\omega^2 r} \qquad \text{Eq. 5}$$

where $\omega$ is the prescribed angular speed of the rotor (radians/sec)

g is the acceleration of gravity ($cm/sec^2$).

The value of h obtained is then the optimum distance of the first annular fluid splitter blade from the interior surface of the housing.

It is therefore seen that by the combination of the relationships, the proper angle of inclination of the separation chamber and the proper position of the first annular fluid splitter blade can be determined for a range of blood properties.

What is claimed is:

1. In concentrically continuous flow centrifuge having a rotor for separating the red blood cell, white blood cell, and plasma components of whole blood into separate zones said rotor comprising a rotatable bowl a closure for said bowl, a generally parabolic core defining an axially extending central whole blood inlet passageway, said core disposed substantially concentricaaly within said bowl the periphery of said core and the interior surface of said bowl being spaced apart to define a whole blood separation chamber therebetween in liquid communication with said whole blood inlet passageway, said separation chamber having substantially radially and substantially axially extending portions whereby whole blood enters the radially extending portion of the whole blood separation chamber from the whole blood inlet passageway and is centrifugally separated into concentric zones of red cells, white cells, and plasma within the axially extending portion of the whole blood separation chamber, and means for extracting said plasma, the improvement comprising a first annular fluid splitter blade disposed between said core and said bowl concentric to said core for separating red and white blood cell zones at their interface, a second annular fluid splitter blade disposed within said core and said bowl concentric to said core and centripetal to said first splitter blade for separating the white blood cell zone and plasma zone at their interface, and said whole blood separation chamber being shaped such that its width decreases with increasing radial distance from the axis of rotation of said rotor such that during operation of said centrifuge the velocity gradient at the walls of said whole blood separation chamber is maintained below about 5 $sec^{-1}$.

2. The centrifuge of claim 1 wherein a plurality of septa rotatable with said rotor are disposed within the upper portion of said central whole blood inlet passageway to induce rotation of entrant blood substantially synchronously with said rotor.

3. The centrifuge of claim 1 wherein a plurality of lower septa rotatable with said rotor are disposed within the lower portion of said central whole blood inlet passageway and within the radially extending portion of said whole blood separation chamber.

4. The centrifuge of claim 1 wherein said first splitter blade and said second splitter blade are axially displaced from one another.

5. The centrifuge of claim 1 wherein said closure is provided with means for optically sensing the interface between said white blood cell zone and said red blood cell zone, and wherein said means for extracting said plasma comprises a variable speed pump and means for controlling said pump speed to position said red blood cell/white blood cell interface at the radial position of said first annular fluid splitter blade, said control means including means to generate a pulse from said optical sensing means, and means for producing a control signal proportional to the amplitude of said pulse for controlling the speed of said pump.

* * * * *

UNITED STATES PATENT OFFICE

CERTIFICATE OF CORRECTION

Patent No. 3,955,755 Dated May 11, 1976

Inventor(s) Julian P. Breillatt, Jr. et al.

It is certified that error appears in the above-identified patent and that said Letters Patent are hereby corrected as shown below:

Col. 9, line 37, delete "concentrically" and insert ---a---.

Signed and Sealed this

Twelfth Day of October 1976

[SEAL]

*Attest:*

RUTH C. MASON
*Attesting Officer*

C. MARSHALL DANN
*Commissioner of Patents and Trademarks*